United States Patent [19]

White

[11] 4,103,806

[45] Aug. 1, 1978

[54] VALVE GUARD FOR PROTECTING THE REGULATOR VALVE ON A SCUBA TANK

[76] Inventor: E. Vernon White, 2 Circle Dr., Apt. 6, Florence, Ky. 41042

[21] Appl. No.: 756,324

[22] Filed: Jan. 3, 1977

[51] Int. Cl.[2] ..... B67B 7/24

[52] U.S. Cl. ..... 222/3; 222/182; 222/153; 222/465; 224/5 BC; 220/8 SP

[58] Field of Search ..... 222/182, 3, 175; 137/382; 220/85 P; 224/5 BC, 5 W

[56] References Cited

U.S. PATENT DOCUMENTS

| | | | |
|---|---|---|---|
| 3,174,664 | 3/1965 | Hue | 224/5 BC |
| 3,185,336 | 5/1965 | Goss | 220/85 P |
| 3,696,964 | 10/1972 | Deakin | 220/85 P |
| 3,756,450 | 9/1973 | Crose, Jr. | 220/85 P |

*Primary Examiner*—Allen N. Knowles
*Attorney, Agent, or Firm*—Lee & Smith

[57] ABSTRACT

A valve guard is mounted on a scuba air tank and includes a protective cap which envelops and shields the air tank regulator valve from damage and abuse during both storage and use of the tank. Flexible air hoses which are coupled to the regulator valve during use may freely pass through apertures provided in the cap. The apertures provide ready access to the regulator valve without requiring removal of the valve guard from the tank. The cap defines a handle for lifting the tank without requiring engagement of the regulator valve.

6 Claims, 8 Drawing Figures

FIG-6
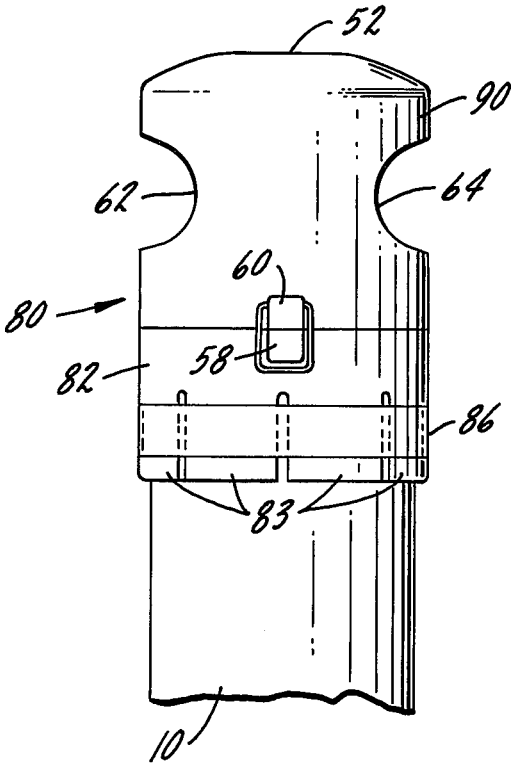
FIG-8
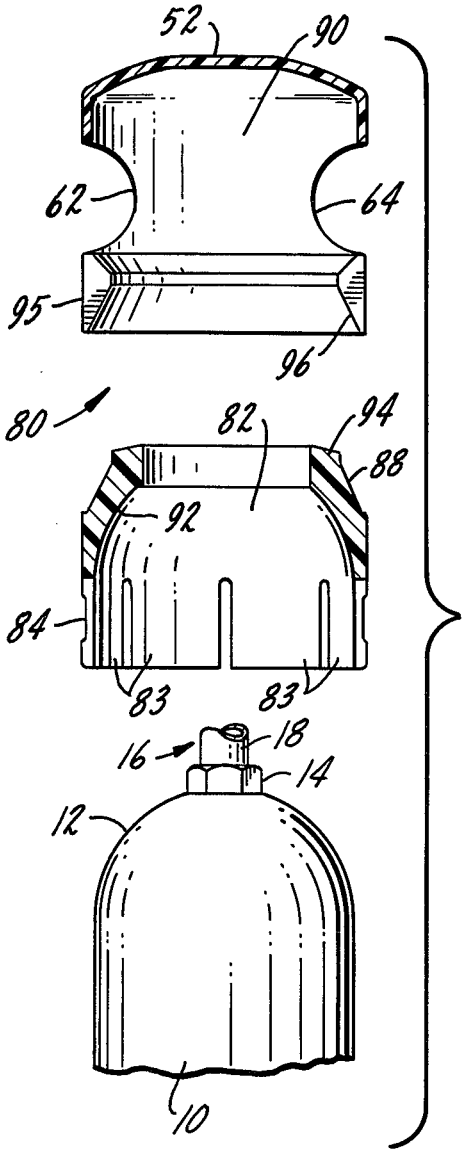
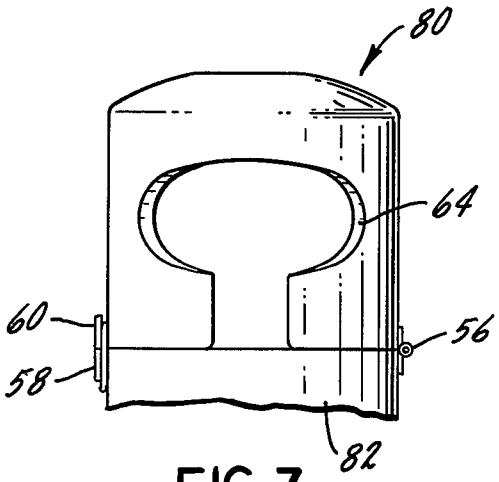
FIG-7

VALVE GUARD FOR PROTECTING THE REGULATOR VALVE ON A SCUBA TANK

BACKGROUND OF THE INVENTION

1. Field of the Invention

The invention is related to means for protecting the valve assembly of a container housing gas under pressure from abuse or damage during both storage and use, and is particularly directed to a valve guard for protecting the regulator valve of a "scuba" (self-contained under water breathing apparatus) air tank.

2. Description of the Prior Art

The most common type of portable container for transporting and storing compressed gases such as oxygen, air and the like is an elongated metal cylinder or tank having at least one substantially semispherical end being formed with a raised, centrally located boss which is provided with a threaded opening for receiving a valve assembly for controlling and regulating the discharge of gas from the cylinder. The valve assembly normally provides the greatest danger to those individuals both using and being about the cylinder as the valve receives a major portion of the abuse given the cylinder as it is repeatedly being coupled to and uncoupled from various hose and pipe assemblies, as well as the valve assembly being exposed to potential abuses since it projects axially outward of the top end of the tank and is thus subject to being struck on passing surfaces as the tank is moved between different locations.

The regulator valve of the scuba air tank is not only subject to the above dangers and abuses but is also subject to dangers during use under water when the user is totally dependent on proper operation of the regulator valve for his air supply. It is, therefore, desirable to protect the regulator valve against damage while the tank is in use as well as during transportation and storage.

It is known to protect the valve assembly during storage, as shown by way of example, in U.S. Pat. Nos. 2,465,095; 3,756,450; and 3,848,768. However, no art has been found which provides means for protecting the regulator valve during both storage and use of the tank.

SUMMARY OF THE INVENTION

The present invention is directed to a valve guard for protecting the regulator valve of a scuba air tank from damage and abuse during both storage and use of the tank. The valve guard includes an enlongate, hollow, cylindrical base portion which is received by the semispherical end of the air tank and engages the cylinder proportion thereof. A protective cap is supported solely by the base portion and projects axially outward of the semispherical end of the tank for enveloping and shielding the regulator valve assembly. The protective cap includes through apertures for permitting ready access to the regulator valve assembly, whereby flexible hose connectors may be readily coupled to the regulator valve. This permits use of the tank without requiring removal of the valve guard. The apertures also permit ready access to the regulator valve assembly, whereby the user may make adjustments in the flow controlled by the regulator valve while the valve guard is in place.

The valve guard is of a design which permits the user to attach the air tank to a "back-pack" harness without interfering with the configuration of the harness and without impairing the freedom of movement of the user when wearing the tank.

A BRIEF DESCRIPTION OF THE DRAWINGS

FIG. 6 is another embodiment of a valve guard which embodies the features of the present invention.

FIG. 7 is a side view of the valve guard shown in FIG. 6.

FIG. 8 is an exploded view of a tank and valve guard assembly as illustrated in FIG. 6, here shown in section.

DETAILED DESCRIPTION OF THE PREFERRED EMBODIMENTS

Figure 1:
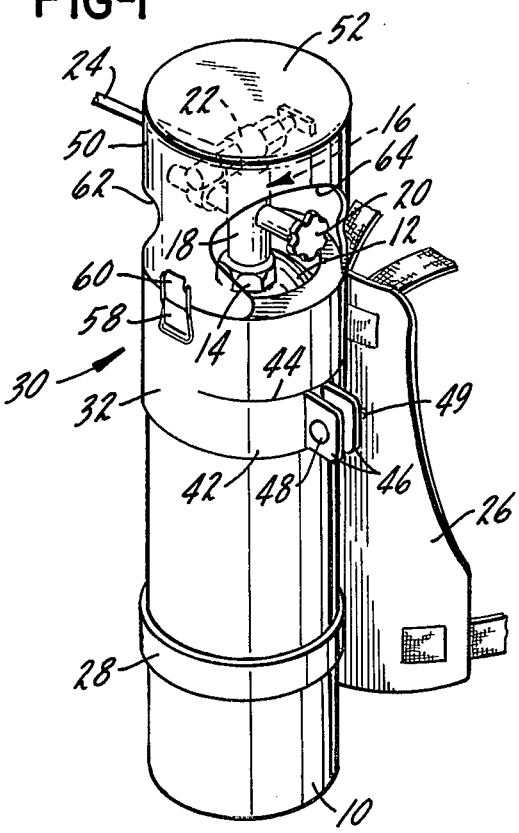
FIG. 1 illustrates a scuba air tank having a harness assembly and including a first embodiment of a valve guard embodying the features of the present invention.

With reference to the drawings, there is shown an air tank 10 of substantially cylindrical configuration and having a semispherical upper end 12. A boss 14 is located centrally of the semispherical end and is adapted for receiving stem 18 of a regulator valve assembly 16 in the well known manner. Typically, the stem 18 includes a threaded end portion and the boss is internally threaded for receiving and securing the stem in communication with the interior of tank 10. The valve assembly includes a control valve 20 for regulating the flow of air from the tank through an outlet gate 22. A flexible conduit such as elongate hose 24 is securely, though releasably, coupled to the outlet gate for transporting the released air to a user in the well known manner. Generally, the tank is mounted on a "back-pack" harness assembly 26 by means of strap 28. The strap is tightened against the cylindrical portion of tank 10 for maintaining the harness assembly in fixed relationship with the tank by means of friction. The harness assembly may be mounted on the back of the user for carrying the air tank without impairing freedom of movement.

Figure 2:
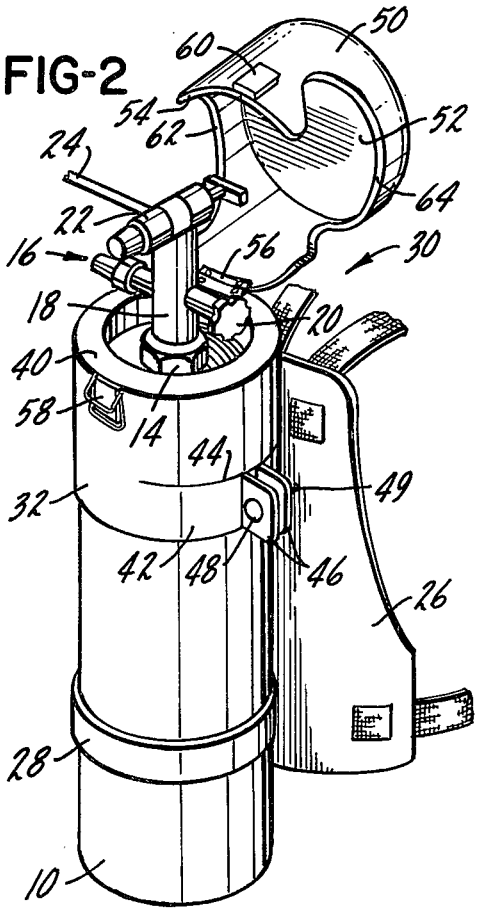
FIG. 2 is a view similar to FIG. 1 and illustrates the valve guard thereof in an open, regulating-valve-exposing position.
Figure 3:
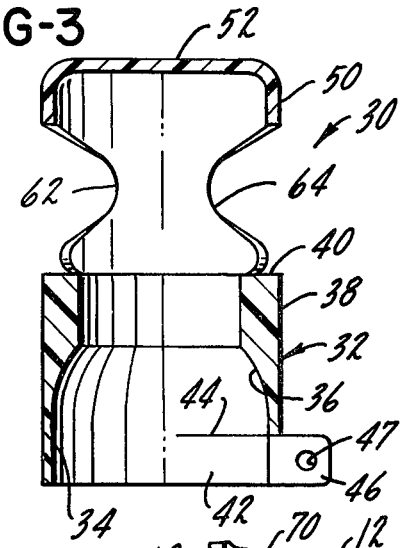
FIG. 3 is a longitudinal section of the valve guard illustrated in FIG. 1.

A first embodiment of the valve guard is illustrated in FIGS. 1–3 and is designated, in general, by the reference numeral 30. The guard is designed to envelop and shield the valve assembly 16 from damage and/or abuse during both storage and use of the air tank.

The valve guard 30 includes an elongated, hollow, cylindrical base portion 32 made of high impact plastic or the like and having cylindrical interior sidewalls 34 which engage the cylindrical portion of tank 10. The inner walls 36 of the upper end of base 32 are contoured to engage the semispherical end 12 of tank 10. The base includes a hollow top section 38 (FIG. 3) which projects upwardly of tank 10 for protecting the valve-receptive boss 14. Top section 38 terminates in a flat rim 40 which defines the bearing surface for supporting the protective cap 50. The base portion 32 is frictionally secured to tank 10 by means of an integral strap 42 having ends separated from base portion 32, as at slits 44, and terminating in radially projecting, spaced apart tabs 46, 46. The clearance hole 47 (FIG. 3) is provided in each tab for receiving tightening means such as, by way of example, bolt 48 and nut 49, whereby the tabs may be drawn together for tightening the strap against the cylindrical portion of the tank.

The protective cap 50 of valve guard 30 is secured to, carried by and solely supported by base portion 32. As shown in FIGS. 1–3, cap 50 is of substantially cylindrical configuration and projects axially upward of the base portion. The cap terminates in a closed end 52 for enveloping and shielding valve assembly 16. The lower end of the cap terminates in a flat surface 54 which is disposed in abutting relationship with rim 40 when the cap is in the closed position shown in FIGS. 1 and 3. The cap is hingedly secured to base portion 32 at hinge 56 and is pivotable between an open, valve-exposing position (FIG. 2) and a closed, valve-enveloping-and-shielding position (FIG. 1). Means are provided for locking the cap in the closed position and may comprise, by way of example, the over-center latch 58 and latch strike 60 suitably mounted on the base portion and the cap, respectively. Apertures or through passageways 62, 64 are provided in the cap for permitting ready access to the valve assembly and for permitting attachment of hose 24 to the outlet gate without requiring removal of the guard or opening of the cap. The apertures 62, 64 define a handle when the cap is locked in the closed position, whereby the valve guard and tank assembly may be lifted without engaging the valve assembly 16.

Figure 5:
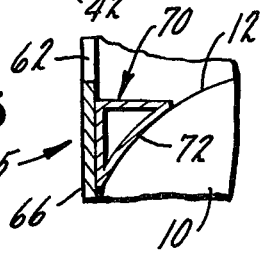
FIG. 5 is a partial longitudinal section of the valve guard of FIG. 4, illustrating in detail the contoured pads for engaging the semispherical end of the air tank.
Figure 4:
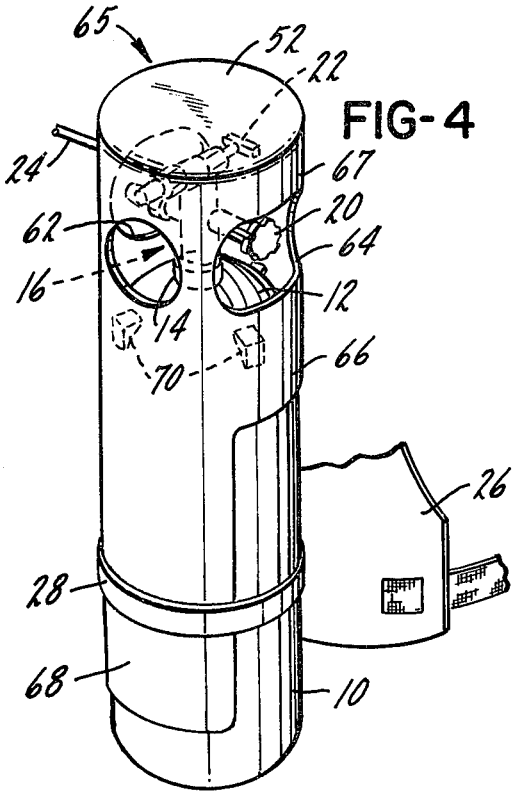
FIG. 4 is a second embodiment of a valve guard embodying the features of the present invention.

A second embodiment of the valve guard is shown in FIGS. 4 and 5 and is designated, in general, by the reference numeral 65. The valve guard 65 includes a cylindrical base portion 66 and a cap 67 of unitary construction and is made of formed steel or the like. Like features of this valve guard are identified by the same reference numerals utilized in describing valve guard 30 of FIGS. 1–3. It should, of course, be understood that each of the illustrated valve guards may be constructed of any high impact material capable of protecting the valve assembly 16 from damage and/or abuse.

The base portion includes a depending section 68 which engages and partially circumscribes the cylindrical portion of tank 10. By locating section 68 diametrically opposite harness assembly 26, the same strap 28 may be utilized to secure both the harness and the valve guard 65 to tank 10. A plurality of pads 70 are spaced about, secured to and project radially inward from the inside wall of base 66, see FIG. 5. The pads may be suitably secured to the base by welding or the like. Each pad has a concave bearing surface 72 contoured to abuttingly engage the semispherical end 12 of tank 10. Apertures 62 and 64 provide ready access to valve assembly 16 and permit free passage of hose 24 without requiring removal of the valve guard.

Another embodiment of the valve guard is illustrated in FIGS. 6–8 and is designated, in general, by the reference numeral 80. Again, like reference numerals are utilized to identify features previously defined in the description of the valve guards of FIGS. 1–5. As shown in FIGS. 6 and 8, base 82 comprises a hollow, substantially cylindrical member terminating at the lower end in a plurality of integral, spaced, depending tabs 83. An elongated, circumferential channel 84 is provided in the tabs for receiving a strap 86 or the like which is utilized to draw the tabs toward one another and tighten the grip of the tabs on the cylindrical portion of tank 10. The strap may be tightened in the well known manner by utilizing an over-center latch (not shown) or the like. The upper end portion of base 82 terminates in a tapered bearing surface 88 which is adapted for engaging a complimentary, mated surface on cap 90. The inner surface 92 of the upper portion is contoured for engaging the semispherical end 12 of tank 10. The reduced upper portion 94 of the base projects axially upward of tank 10 for protecting boss 14. Cap 90 is hingedly secured to base 83 at hinge 56 (FIG. 7). Locking means such as the over-center latch 58 and latch strike 60 are employed for locking the cap in closed position. As in the embodiment of FIGS. 1–3, the cap of guard 80 is pivotable between the closed, valve-shielding position shown in FIGS. 6 and 7 and an open, valve-exposing position. The lower end of the cap terminates in the base-engaging portion 95 which includes an inner, tapered bearing surface 96 that is complimentary to and mated with bearing surface 88 of base 82 when the cap is in the closed position. Again it will be noted that apertures 62 and 64 are provided for permitting ready access to the valve assembly 16 and for permitting free passage of hose connectors through the cap.

It will be noted that the corners and edges of each of the embodiments have been generally rounded to minimize the risk of injury to the user. It will, of course, be understood that attachment of the cap to the base by means of a hinge and latch is only exemplary and other means may be employed without departing from the scope and spirit of the invention.

What is claimed is:

1. A valve guard for protecting a regulator valve assembly of an air tank for a self-contained underwater breathing apparatus from damage and abuse during both storage and use, the air tank being of substantially cylindrical configuration and including a semispherical end having a boss located centrally thereof with the valve assembly received therein and projecting axially therefrom, the valve guard being releasably secured to and supported solely by the air tank and comprising:

a. an elongate, hollow, cylindrical base portion for receiving the semispherical end of the tank and for engaging the cylindrical portion of the tank adjacent to said semispherical end, said base portion including an upper end terminating in a bearing surface which projects radially of the cylindrical base portion;

b. tightening means carried by the base portion for selectively securing the base portion to the cylindrical portion of the tank by increasing the friction-gripping force therebetween; and c. a protective cap releasably secured to the base portion and projecting axially outward from the semispherical end of the tank, said cap of hollow, substantially cylindrical configuration conforming to and disposed in alignment with the cylindrical base portion and having a closed outer end for enveloping and shielding the regulator valve assembly, the cap including through apertures in the cylindrical portion thereof for permitting ready access to the regulator valve assembly, said cap being movable between an open, valve-assembly-exposing position and a closed bearing-surface-engaging position, wherein said cap is in abutting engagement with said bearing surface when in the closed position; and a locking device mounted on said cap for selectively locking the cap in the closed position relative to the base portion.

2. A valve guard as called for in claim 1, including a concave walled inner support surface adjacent to and depending from said bearing surface for engaging the semispherical end of the tank.

3. A valve guard as called for in claim 1, wherein the tightening means comprises a band having spaced apart ends and integral with said base portion and partially circumscribing the cylindrical portion of the tank, and means for drawing the spaced apart ends toward one another for tightening the friction-grip between the tank and the base portion.

4. A valve guard as called for in claim 1, wherein said base portion comprises a hollow cylindrical member having an upper end including concave inner walls for engaging the semispherical end of the tank and having a lower end defined by a plurality of spaced apart, depending tabs collectively disposed about and in engagement with the periphery of the cylindrical portion of the tank, and wherein said tightening means comprises a strap circumscribing the cylindrical portion of the tank and disposed outboard of the tabs for urging the tabs into engagement with the tank.

5. A valve guard as called for in claim 4 wherein the bearing surface is a tapered outer surface for supporting the cap and wherein the cap includes a bearing-surface-engaging end which is of complementary taper.

6. A valve guard as called for in claim 1, wherein the cap and apertures define a hand-receptive handle for lifting the tank without engaging the valve guard assembly.

* * * * *